US008421831B2

(12) United States Patent
Matsuoka et al.

(10) Patent No.: US 8,421,831 B2
(45) Date of Patent: Apr. 16, 2013

(54) IMAGE FORMING APPARATUS, IMAGE FORMING METHOD, AND PROGRAM

(76) Inventors: Jun Matsuoka, Kanagawa (JP); Ken Higuchi, Kanagawa (JP)

( * ) Notice: Subject to any disclaimer, the term of this patent is extended or adjusted under 35 U.S.C. 154(b) by 0 days.

(21) Appl. No.: 13/220,111

(22) Filed: Aug. 29, 2011

(65) Prior Publication Data

US 2012/0056965 A1 Mar. 8, 2012

(30) Foreign Application Priority Data

Sep. 2, 2010 (JP) ..... P2010-196649

(51) Int. Cl.
*B41J 2/325* (2006.01)

(52) U.S. Cl.
USPC ..... 347/212; 400/120.18

(58) Field of Classification Search ..... 347/171, 347/172, 174, 176, 212; 400/20.01, 120.02, 400/120.04, 120.181, 120.01, 120.18
See application file for complete search history.

(56) References Cited

U.S. PATENT DOCUMENTS 8,149,255 B2 * 4/2012 Higuchi et al. ..... 347/175
8,174,549 B2 * 5/2012 Murakami ..... 347/175
2009/0035493 A1 * 2/2009 Murakami et al. ..... 428/32.77
2009/0256899 A1 * 10/2009 Murakami ..... 347/200
2012/0044314 A1 * 2/2012 Higuchi et al. ..... 347/214
2012/0056964 A1 * 3/2012 Matsuoka et al. ..... 347/213

FOREIGN PATENT DOCUMENTS

EP 2020296 * 2/2009
JP 2009-248520 10/2009

* cited by examiner

*Primary Examiner* — Huan Tran
(74) *Attorney, Agent, or Firm* — Sony Corporation

(57) ABSTRACT

An image forming apparatus includes a conveyance unit conveying a medium to be recorded in a predetermined direction, a thermal transfer sheet including an ink layer thermally transferred onto the medium to form a printing layer, and a protective material layer thermally transferred onto the medium to form a protection layer, a transfer sheet traveling unit causing the thermal transfer sheet to travel, a reforming sheet including a printing opening for bringing the ink layer and the protective material layer into contact with a surface of the medium, and a surface property reforming unit reforming the surface property of the protection layer, a reforming sheet traveling unit causing the reforming sheet to travel, and a thermal head pressing the surface property reforming unit on the medium through the protective material layer having been thermally transferred to thereby heat the pressed surface property reforming unit.

6 Claims, 12 Drawing Sheets

IMAGE FORMING APPARATUS, IMAGE FORMING METHOD, AND PROGRAM

BACKGROUND

The present disclosure relates to an image forming apparatus, an image forming method, and a program.

Currently, as a thermal transfer printer, printers of a sublimation type, a fusion type, and a thermal type are widely used. However, in the thermal transfer printer, there is a case in which the glossiness of an image is damaged due to minute irregularities formed on an image surface. Thus, in the related art, the image surface is flattened by heating and pressing a flat surface on the image surface, thereby improving the glossiness of the image.

For example, in Japanese Unexamined Patent Application Publication No. 2009-248520, there has been disclosed an image forming method in which the glossiness of an image is improved using a thermal transfer sheet including an ink layer and a protective material layer, and a reforming sheet including a printing opening and a surface property reforming unit.

In this method, first, the reforming sheet is sandwiched in between a medium to be recorded and the thermal transfer sheet. Next, the ink layer is transferred onto the medium to be recorded through the printing opening to thereby form a printing layer (image), and the protective material layer is transferred onto the medium to be recorded to thereby form a protection layer on the printing layer. Next, the thermal transfer sheet and the reforming sheet are aligned, and a flat surface of the surface property reforming unit is pressed on the protection layer through a protective material layer region after transferring the protective material layer (hereinafter, referred to as "transferred protective material layer") to thereby be heated, so that surface property of the protection layer is reformed.

SUMMARY

Here, in a process of reforming the surface property, it is preferable to perform heating and pressing through the transferred protective material layer which is in a uniform state. This is because, when performing heating and pressing through the transferred protective material which is not in the uniform state, a protective material remaining on the protective material layer may be adhered to the reforming sheet.

However, in practice, there is a case in which the heating and pressing is performed through the transferred protective material layer which is not in the uniform state due to a positioning error occurring between the thermal transfer sheet and the reforming sheet. In addition, when the protective material is adhered to the reforming sheet, thermal characteristics of the'reforming sheet between a protective material-adhered region and a protective material-nonadhered region are changed, so that a reforming failure of the surface property or a peeling failure of the reforming sheet occurs.

Therefore, in the present disclosure, there is disclosed an image forming apparatus, an image forming method, and a program, in which it is possible to suppress the adhesion of the protective material to the reforming sheet which is caused by a positioning error of the thermal transfer sheet.

According to an embodiment of the present disclosure, there is provided an image forming apparatus, including: a conveyance unit that conveys a medium to be recorded in a predetermined direction; a thermal transfer sheet that includes an ink layer which is thermally transferred onto the medium to be recorded to form a printing layer, and a protective material layer which is thermally transferred onto the medium to be recorded to form a protection layer; a transfer sheet traveling unit that causes the thermal transfer sheet to travel; a reforming sheet that includes a printing opening for bringing the ink layer and the protective material layer into contact with a surface of the medium to be recorded, and a surface property reforming unit for reforming the surface property of the protection layer; a reforming sheet traveling unit that causes the reforming sheet to travel; and a thermal head that presses the surface property reforming unit on the medium to be recorded through the protective material layer having been thermally transferred to thereby heat the pressed surface property reforming unit, while thermally transferring the ink layer and the protective material layer on the medium to be recorded. Here, a region to form the protection layer may be expanded to be wider than a region to reform the surface property of the protection layer.

Also, the region to form the protection layer may be expanded to be wider than the region to reform the surface property of the protection layer in a conveying direction of the medium to be recorded.

Also, the region to form the protection layer may be expanded to be wider than the region to reform the surface property of the protection layer in a direction perpendicular to a conveying direction of the medium to be recorded.

Also, the region to form the protection layer may be expanded to a margin part in which the medium to be recorded is expanded.

According to another embodiment of the present disclosure, there is provided an image forming method, including: sandwiching a reforming sheet including a printing opening and a surface property reforming unit in between a medium to be recorded and a thermal transfer sheet including an ink layer and a protective material layer; causing the medium to be recorded, the thermal transfer sheet, and the reforming sheet to travel in a predetermined direction; thermally transferring the ink layer onto the medium to be recorded to form a printing layer by enabling a printing position of the medium to be recorded and the ink layer to be aligned with the printing opening; thermally transferring the protective material layer onto the medium to be recorded to form a protection layer by enabling the printing position of the medium to be recorded and the protective material layer to be aligned with the printing opening; and pressing the surface property reforming unit on the medium to be recorded through the protective material layer having been thermally transferred by enabling the printing position of the medium to be recorded and the protective material layer to be aligned with the surface property reforming unit, and heating the pressed surface property reforming unit to thereby reform surface property of the protection layer. Here, a region to form the protection layer may be expanded to be wider than a region to reform the surface property of the protection layer.

According to still another embodiment of the present disclosure, there is provided a program for executing, in a computer, the image forming method. Here, the program may be provided using a computer-readable recording medium, and provided through a communication unit, and the like.

As described above, there are provided an image forming apparatus, an image forming method, and a program which may suppress the adhesion of the protective material to the reforming sheet which is caused by a positioning error of the thermal transfer sheet.

DETAILED DESCRIPTION OF EMBODIMENTS

Figure 1:
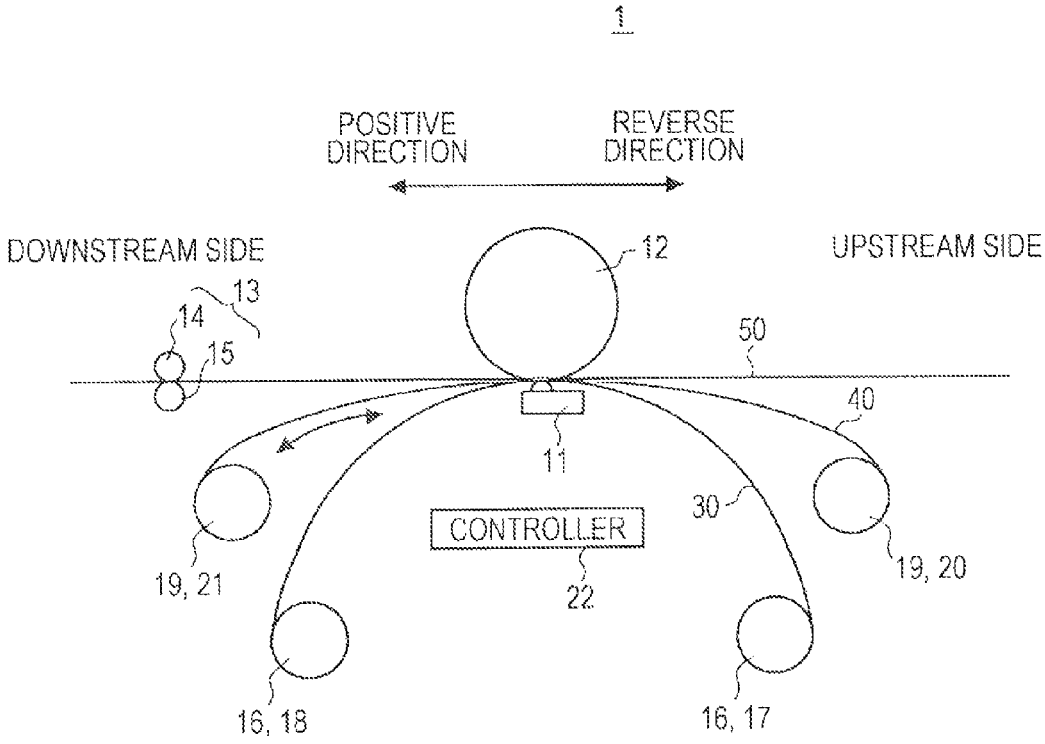
FIG. 1 is a schematic diagram showing a principle configuration of an image forming apparatus.

Hereinafter, exemplary embodiments of the disclosure will now be described in detail with reference to the accompanying drawings. Throughout the drawings and the detailed description, the same reference numerals are attached to constituent elements having substantially the same function and structure, and thus repeated description thereof will be omitted.

1. Configuration of Image Forming Apparatus 1

First, an example of an image forming apparatus 1 applied to the present disclosure will be described with reference to FIGS. 1 to 7. Further, hereinafter, as an example of the image forming apparatus 1, a case of a sublimation type printer will be described. In FIG. 1, a principle configuration of the image forming apparatus 1 is shown.

As shown in FIG. 1, in the image forming apparatus 1, a thermal head 11, a medium 50 to be recorded, a thermal transfer sheet 30, and a reforming sheet 40 are provided. Hereinafter, the medium 50 to be recorded is referred to as a recording paper 50, the thermal transfer sheet 30 is referred to as an ink ribbon 30, and the reforming sheet 40 is referred to as a reforming ribbon 40.

In the thermal head 11, a plurality of heating elements (not shown) is arranged in a line state. The plurality of heating elements is selectively conducted according to a gradation level of a printing image, thereby generating heat energy used for transfer. The thermal head 11 transfers an ink layer 33 (ink dye) formed in the ink ribbon 30 onto the recording paper 50 so that a printing layer 51 (image) is formed on the recording paper 50. In addition, the thermal head 11 transfers a protective material layer 35 (protective material 36) formed in the ink ribbon 30 onto the recording paper 50 so that a protection layer 52 is formed on the printing layer 51 formed on the recording paper 50.

The recording paper 50 is installed in a predetermined position as a roll paper, and conveyed, if necessary. The recording paper 50 is sandwiched by a conveyance unit 13 including, for example, a pinch roller 14 and a capstan 15, and fed to an upstream side and a downstream side by normal and reverse rotation drive of the conveyance unit 13. Further, the upstream side and the downstream side respectively denote a paper feeding side and a paper discharging side of the recording paper 50. The recording paper 50 is drawn out by the conveyance unit 13, passes between the thermal head 11 and a platen roller 12 for printing, and is cut by a cutter C (see, FIGS. 8 and 11) in the downstream side after forming the image (formation of the printing layer 51 and the protection layer 52 and surface property reforming process) to be discharged.

In addition, the recording paper 50 is not limited to a rolled sheet, and a non-rolled sheet such as a cut sheet, or the like may be used as the recording paper 50. In this case, cutting of the recording paper 50 is not necessary, so that the cutter C may be omitted.

The ink ribbon 30 is fed by an ink ribbon traveling unit 16 that includes a supply reel 17, a winding reel 18, and a plurality of guide rollers (not shown). The ink ribbon 30 is drawn out from the supply reel 17, guided to the guide roller, passes between the thermal head 11 and the platen roller 12, and is then sequentially wound on the winding reel 18.

The reforming ribbon 40 is disposed so as to intervene between the recording paper 50 and the ink ribbon 30. The reforming ribbon 40 is fed by a reforming ribbon traveling unit 19 that includes a supply reel 20, a winding reel 21, and a plurality of guide rollers (not shown). The reforming ribbon 40 is drawn out from the supply reel 20, guided to the guide roller, passes between the thermal head 11 and the platen roller 12, and is then wound on the winding reel 21. The reforming ribbon 40 is freely fed in two directions, i.e. a direction from the upstream to the downstream and the reverse direction.

In addition, in the image forming apparatus 1, a controller 22 for controlling operations of the image forming apparatus 1 is provided. The controller 22 is configured as hardware and/or software. The controller 22 includes a CPU, ROM, RAM, and the like, and the CPU expands and executes, on the RAM, a program read from the ROM, etc, so that the image forming method according to the present disclosure may be realized.

Figure 2:
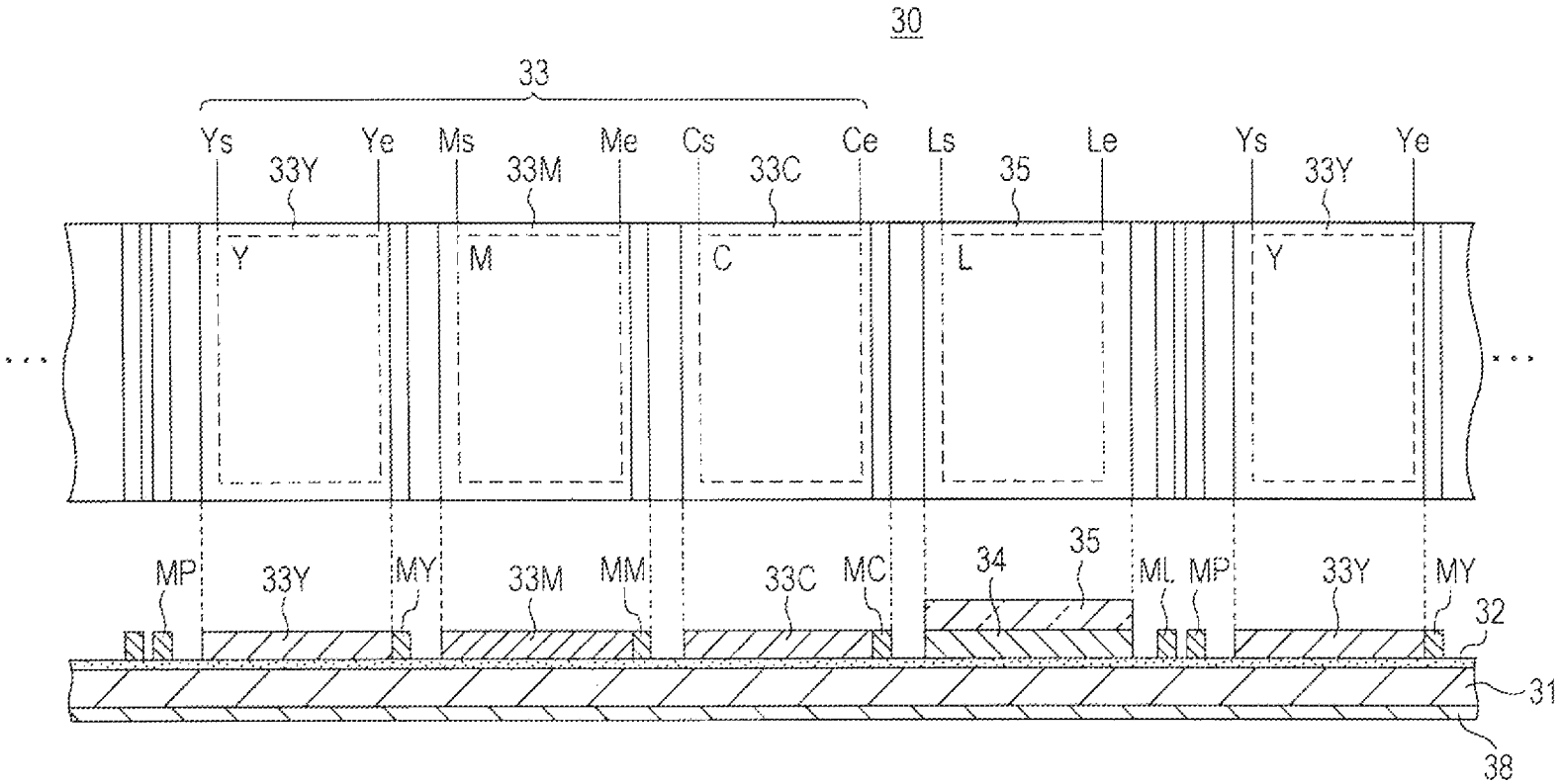
FIG. 2 is a diagram showing a configuration of an ink ribbon.

In FIG. 2, a configuration of the ink ribbon 30 is shown. As shown in FIG. 2, in the ink ribbon 30, an easy adhesion layer 32 is formed on a surface of a base material 31. In the easy adhesion layer 32, ink layers 33Y, 33M, and 33C of yellow (Y), magenta (M), cyan (C) are formed, and a transparent protective material layer 35 is formed through a peeling layer 34. As for the ink layer 33 (general term of ink layers) and the protective material layer 35, the ink layers 33Y, 33M, and 33C, and the protective material layer 35 are periodically formed in the stated order. The ink layer 33 is formed such that a dye such as a sublimable dye, or the like is coated, and the protective material layer 35 is formed such that the protective material 36 of a transparent laminate resin, and the like is coated.

The protective material layer 35 is transferred after the printing layer 51 is formed on the recording paper 50 by the transfer of the ink layer 33, so that the protection layer 52 for protecting the printing layer 51 is formed. The protection layer 52 improves chemical resistance, solvent resistance, oil and fat resistance, abrasion resistance, and the like of the printing layer 51. In addition, the protection layer 52 improves glossiness and quality of an image.

The protective material layer 35 is formed on the easy adhesion layer 32 through the peeling layer 34. Thus, when transferring the protective material layer 35, peeling is generated on an interface between the peeling layer 34 and the protective material layer 35, the peeling layer 34 remains in the ink ribbon 30 side, and the protective material layer 35 (protective material 36) is transferred onto the recording paper 50. Therefore, transferability of the protective material layer 35 is improved.

In addition, a heat-resistant lubricant layer 38 is formed in the other surface of the base material 31. The heat-resistant lubricant layer 38 reduces friction between the thermal head 11 and the ink ribbon 30, and stabilizes traveling of the ink ribbon 30.

The ink layer 33 and the protective material layer 35 are formed as a region larger than a region actually transferred on the recording paper 50. The ink layer 33 and the protective material layer 35 are formed so as to surround the actually transferred region. In the ink layer 33 and the protective material layer 35, transfer start position/end positions Ys/Ye, Ms/Me, Cs/Ce, and Ls/Le are set in a start end side and a termination end side of a traveling direction of the ink ribbon 30.

In the ink ribbon 30, a marker M (general term for markers) used for positioning of the ink layers 33Y, 33M, and 33C, and the protective material layer 35 is formed. The marker M includes markers MY, MC, and MM indicating each position of the ink layers 33Y, 33M, and 33C, and a position of the protective material layer 35, and a marker MP indicating the period of a combination of the ink layers 33Y, 33M, and 33C, and the protective material layer 35.

Figure 3:
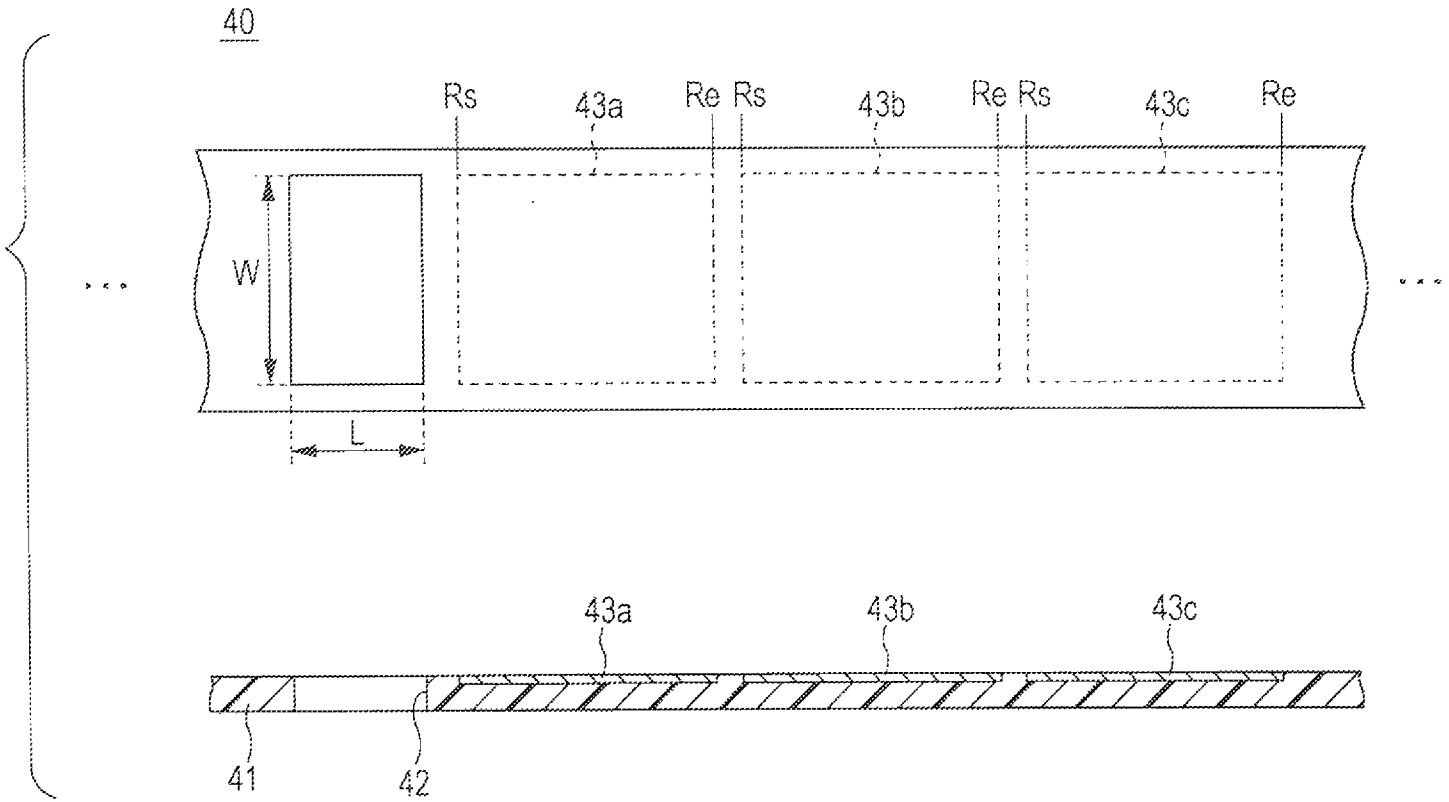
FIG. 3 is a diagram showing a configuration of a reforming ribbon.

In FIG. 3, a configuration of the reforming ribbon 40 is shown. As shown in FIG. 3, a printing opening 42 and a surface property reforming unit 43 (general term for surface property reforming units) are formed side by side on a base material 41 in a longitudinal direction. The base material 41 is formed by a resin material such as a polyimide, and the like.

In the printing opening 42, an opening for bringing the ink ribbon 30 into contact with the recording paper 50 is formed. A width W of the printing opening 42 is formed slightly larger than a length in a main scanning direction of the thermal head 11.

In the surface property reforming unit 43, a reforming surface for reforming the surface property of the protection layer 52 formed on the recording paper 50 is formed. The reforming surface is formed in a surface of a side pressed against the recording paper 50 in the surface property reforming process. The reforming surface is formed as a mirror surface, a matte-finish irregular surface, a silk-finish irregular surface and the like in accordance with the specifications of the surface property of the final printed article which is image-formed. In the surface property reforming unit 43, reforming start/end positions Rs/Re are set in a start end side and a termination side of a traveling direction of the ink ribbon 30.

In FIG. 3, an example in which a first surface property reforming unit 43*a* for an ultra-glossy surface, a second surface property reforming unit 43*b* for a matte tone surface, and a third surface property reforming unit 43*c* for a silky tone surface are formed as the surface property reforming unit 43 is shown. However, the number and types of the surface property reforming units 43 are not limited to this example.

In the base material 41, for example, the printing opening 42 and the surface property reforming units 43*a*, 43*b*, and 43*c* are periodically formed. In addition, the reforming ribbon 40 is appropriately and freely caused to travel so that the printing opening 42 is located in a position corresponding to a heating element of the thermal head 11 when forming the printing layer 51 and the protection layer 52, and the surface property reforming unit 43 is located in a position corresponding to the heating element when performing a surface property reforming process. The reforming ribbon 40 is able to be repeatedly used.

2. Image Forming Process

Figure 4:
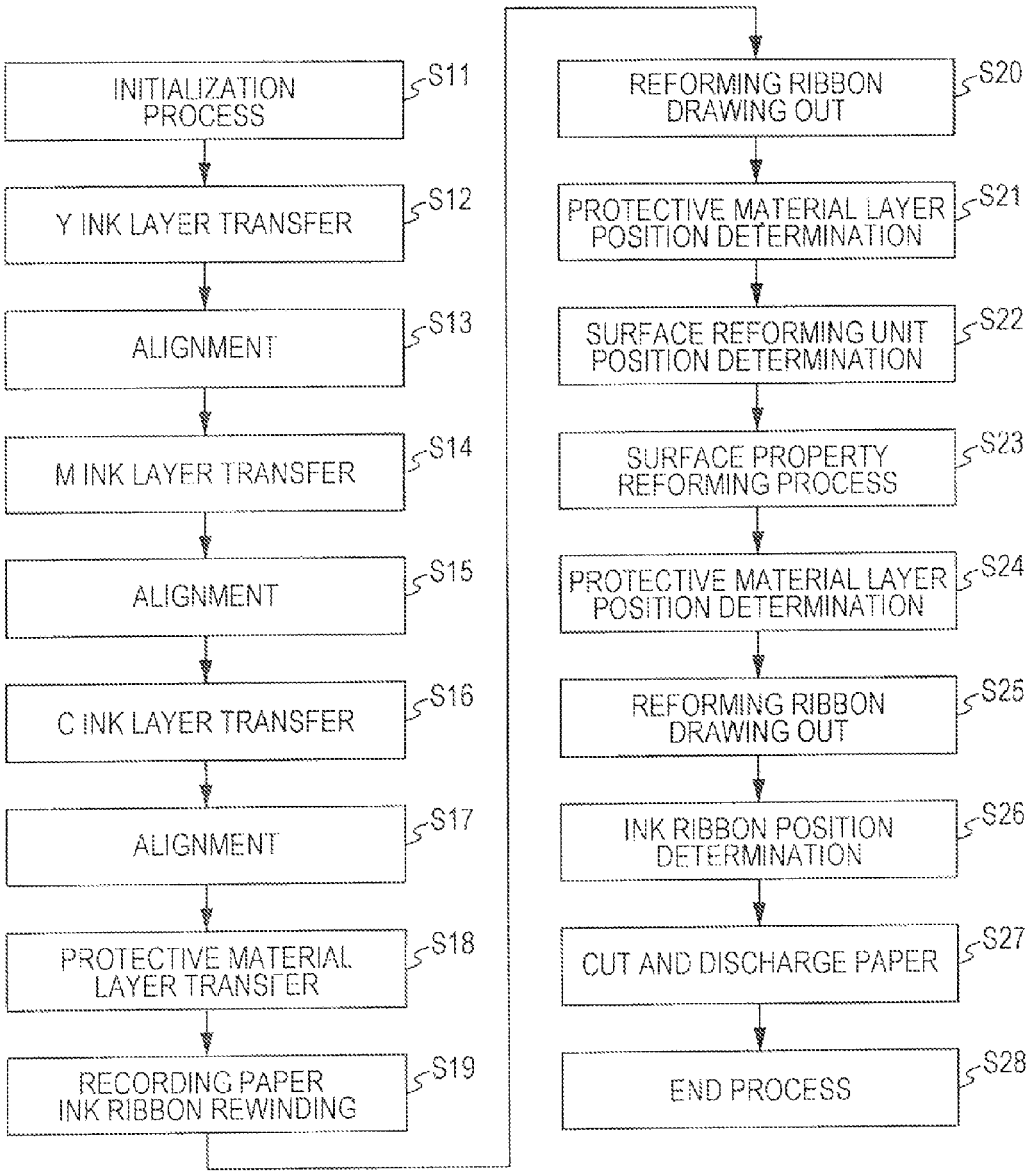
FIG. 4 is a flowchart showing a principle process of an image forming process.

In FIG. 4, a principle process of the image forming process is shown. As shown in FIG. 4, an initialization process (step S11) necessary for the image forming process is performed. The initialization process includes positioning between a transfer start position Ys of the ink layer 33Y and a printing start position of the recording paper 50. When the positioning is completed, the ink layer 33Y is transferred onto the recording paper 50 (step S12). Similarly, with respect to the ink layers 33M, and 33C, and the protective material layer 35, the positioning is performed (steps S13, S15, and S17) by the drawn-out ink ribbon 30 and the rewound recording paper 50, and transfer is performed after the positioning is completed (steps S14, 16, and S18).

The glossiness of the image is improved to some extent by the formation of the protection layer 52; however, there is a case in which desired glossiness is not necessarily obtained. This is because a surface of the protection surface 52 is formed in the base material 31 as a peeling surface of the protective material layer 35 peeled from the peeling layer 34 having insufficient flatness. Therefore, using the surface property reforming unit 43 having desired surface property, the surface property reforming process for reforming the surface property of the protection layer 52 is performed.

When the formation of the printing layer 51 and the protection layer 52 is completed, the recording paper 50 and the ink ribbon 30 are rewound (step S19), and the reforming ribbon 40 is drawn out (step S20). Next, a transfer start position Ls of the protective material layer 37 having been transferred (see FIG. 7), and a reforming start position Rs of the surface property reforming unit 43 are positioned (steps S21 and S22). When the positioning is completed, the protection layer 52 is heated in a state of being pressed against the surface property reforming unit 43 through the protective material layer 37 having been transferred. Due to this, the surface property of the surface property reforming unit 43 is transferred on a surface of the protection layer 52, so that the surface property of the protection layer 52 is reformed (step S23).

When the surface property reforming process is completed, the protective material layer 35 is positioned (step S24), and the reforming ribbon 40 and the ink ribbon 30 are rewound (steps S25 and S26). That is, the reforming unit 40 is rewound so that the printing opening 42 is located in the position corresponding to the heating element, and the ink ribbon 30 is rewound so that the untransferred ink layer 33Y of the next period is located in the position corresponding to the heating element. Next, the recording paper 50 is cut and discharged (step S27), a predetermined completion process (step S28) is performed.

Figure 5:
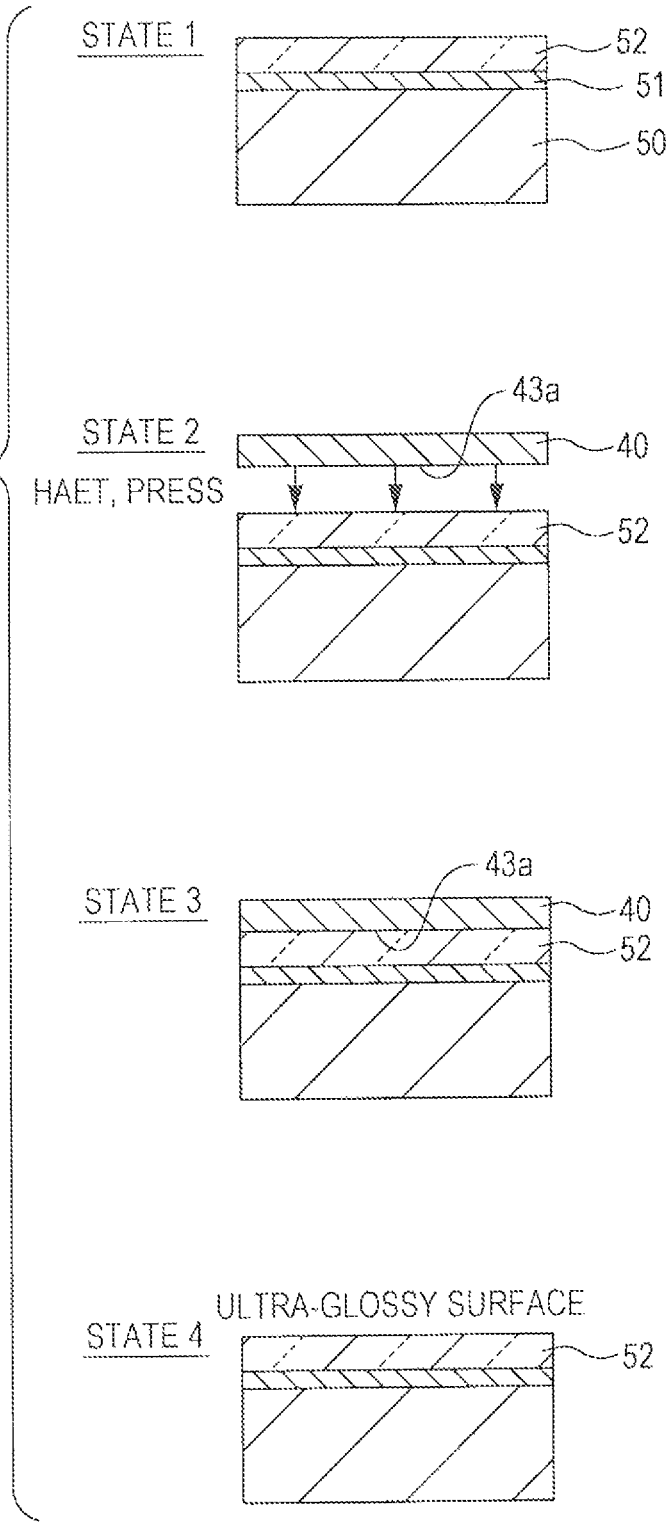
FIG. 5 is a cross-sectional view showing a principle process of an image forming process.

In FIG. 5, a principle process of an image forming process is shown. In FIG. 5, an example in which a surface of the protection layer 52 is reformed to an ultra-glossy surface using the surface property reforming unit 43 having a mirror surface as the reforming surface is shown.

First, as shown in a state 1, the printing layer 51 is formed on the recording paper 50 by the transfer of the ink layer 33, and the protection layer 52 is further formed by the transfer of the protective material layer 35. Here, at the time of the transfer of the ink layer 33 and the protective material layer 35, the ink layer 33 and the protective material layer 35 are brought into contact with the recording paper 50 through the printing opening 42.

Next, before the start of the reforming process, the ink ribbon 30 and the reforming ribbon 40 are positioned. Here, in the reforming process, the reforming surface of the surface property reforming unit 43 is brought into contact with the recording paper 50, and the protective material layer 37 having been transferred is brought into contact with the other surface of the surface property reforming unit 43. Thus, the ink ribbon 30 and the reforming ribbon 40 are positioned by rotation driving of the ink ribbon traveling unit 16 and the reforming ribbon traveling unit 19, so that the transfer start position Ls (corresponding to the start position of the protective material layer 37 having been transferred) of the protection layer 52, and the reform start position Rs of the reforming process of the surface property reforming unit 43 are matched with each other as much as possible.

Specifically, immediately after forming the protective material layer 35, on the ink ribbon 30, the transfer end position Le of the protective material layer 35 corresponds to the position of the heating element. In addition, on the reforming ribbon 40, the printing opening 42 corresponds to the position of the heating element. Due to this, at the time of the start of the reforming process, the ink ribbon 30 is caused to travel so that the transfer start position Ls of the protective material layer 35 corresponds to the position of the heating element. In addition, the reforming ribbon 40 is caused to travel so that a predetermined reforming start position Rs of the surface property reforming unit 43 corresponds to the position of the heating element.

When the positioning is completed, as shown in a state 2, the reforming process is performed by pressing and heating the reforming sheet 40 against the recording paper 50. The reforming process is performed such that the surface property reforming unit 43 is pressed against the protection layer 52 by the thermal head 11 and the platen roller 12, and the recording paper 50, the ink ribbon 30, and the reforming ribbon 40 are simultaneously moved in a state in which the protection layer 52 is heated to about 70° C. to 120° C. by heat energy of the heating element.

Then, as shown in a state 3, the protection layer 52 has a temperature near a glass transition temperature, and is brought into close contact with the surface property reforming unit 43 in a state of being slightly softened. Thus, the surface of the protection layer 52 is reformed to a desired surface property in such a manner that the surface property of the surface property reforming unit 43 is transferred. Next, a temperature of a region being subjected to the reforming process is reduced as the protection layer 52 is separated from the thermal head 11, so that the reforming ribbon 40 is sequentially peeled from the protection layer 52. As a result, as shown in a state 4, the surface of the protection layer 52 is reformed to the ultra-glossy surface equivalent to a silver halide photograph.

Figure 6:
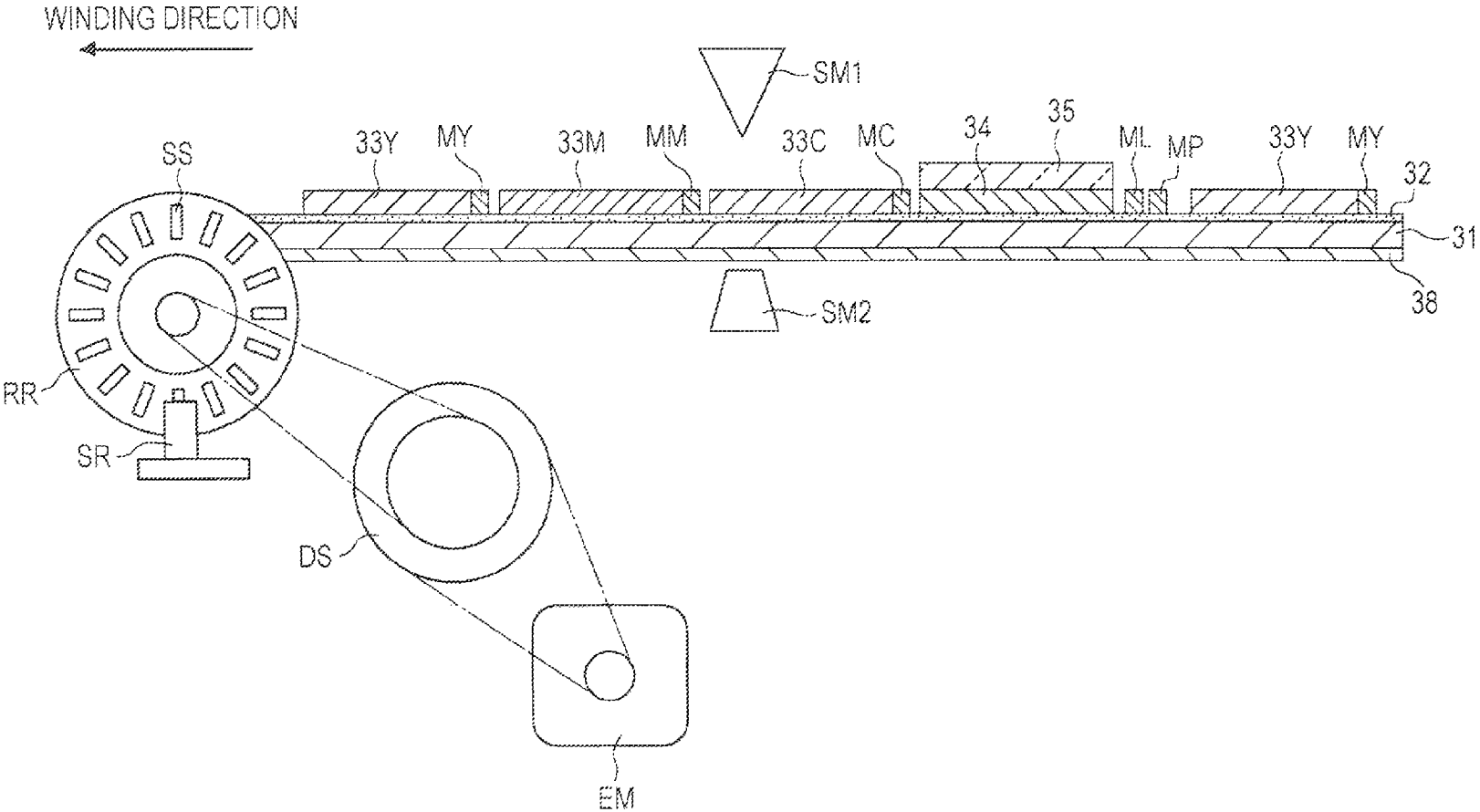
FIG. 6 is a diagram showing a positioning mechanism of an ink ribbon.

In FIG. 6, an example of a positioning mechanism of the ink ribbon 30 is shown. As shown in FIG. 6, the positioning mechanism includes a marker sensor SM (SM1 and SM2) for detecting the marker M on the ink ribbon 30, and a reel sensor SR for detecting a rotation angle of a winding reel RR.

The marker sensor SM includes a light emitting unit SM1 such as an LED, or the like that is disposed in a surface side of the ink ribbon 30 on a traveling path of the ink ribbon 30, and a light receiving unit SM2 that is disposed in the other surface side thereof. The marker sensor SM detects the marker M by detecting a state in which light emitted from the light emitting unit SM1 is shielded by the marker M. The reel sensor SR detects the rotation angle of the reel RR by counting slits SS, or the like that are formed on a rotation surface of the winding reel RR at certain intervals.

For example, in a case in which the protective material layer 35 is positioned, the winding reel RR is driven to be normally rotated by a motor EM and a reel driving system DS until the marker ML of the protective material layer 35 is detected, and when the marker M is detected, the driving of the motor EM is stopped. Next, the winding reel RR is driven to be reversely rotated by the motor EM and the reel driving system DS until a predetermined rotation angle is detected, and when the predetermined rotation angle is detected, the driving of the motor EM is stopped. The predetermined rotation angle is set based on a distance from a position of the marker M to the transfer start position Ls of the protective material layer 35.

Thus, in the positioning of the ink ribbon 30, an error ΔE occurs due to the detection accuracy of the marker sensor SM and the reel sensor SR, resolution (interval of slits SS) of the reel sensor SR, follow-up property of the reel driving system DS, and the like. In addition, there is a case in which the protective material 36 is adhered to the reforming ribbon 40 due to the positioning error ΔE in the surface property reforming process.

Figure 7:
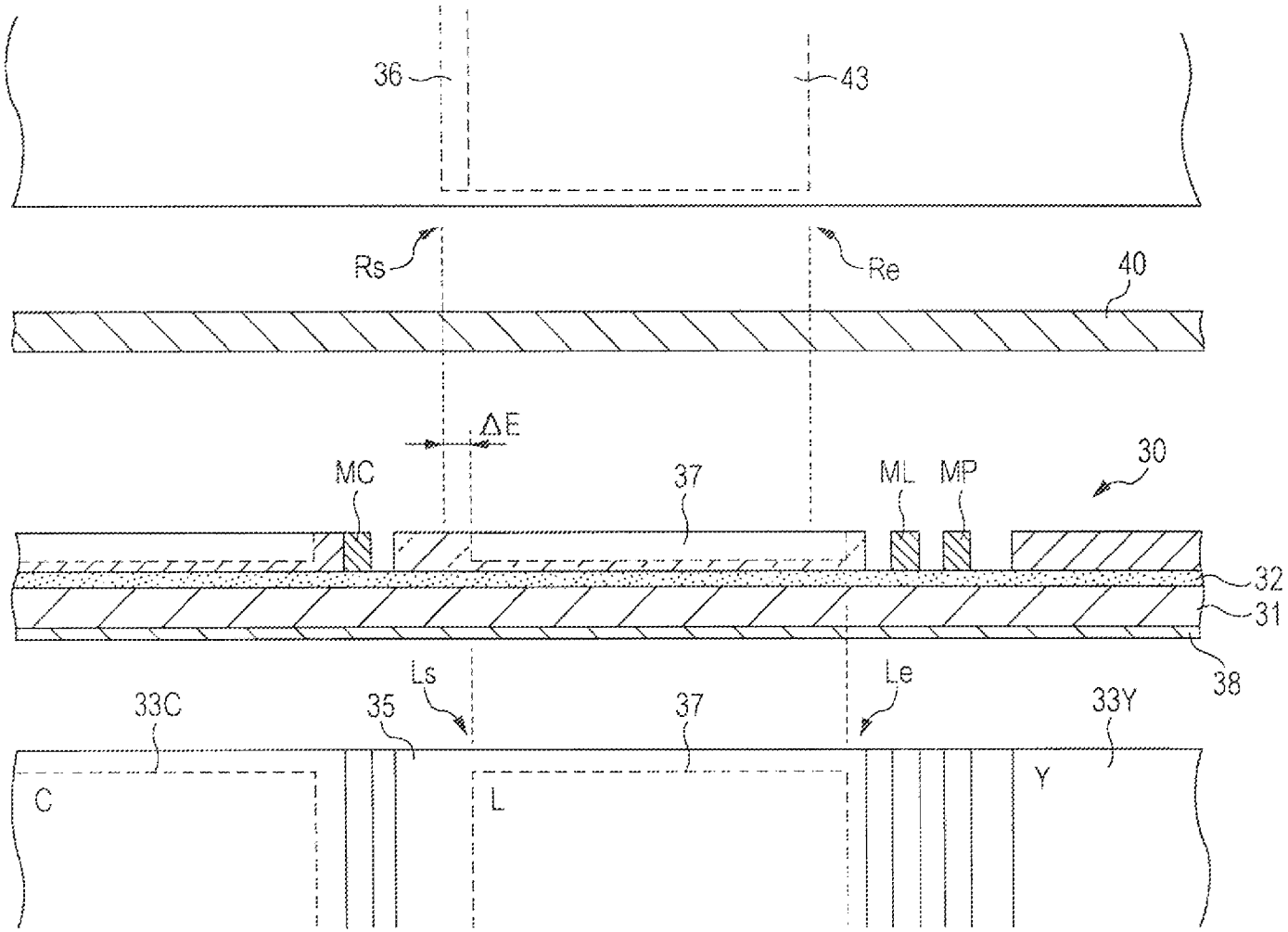
FIG. 7 is a diagram showing an adhesion state of a protective material due to a positioning error.

In FIG. 7, an adhesion state of the protective material 36 due to the positioning error ΔE is shown. In FIG. 7, a plan view and a cross-sectional view of the ink ribbon 30 and the reforming ribbon 40 are shown.

On the ink ribbon 30, the ink layers 33C and 33Y, and the protective material layer 35 are shown. The ink ribbon 33C and the protective material layer 35 are in a state of having been transferred to the recording paper 50, and the ink layer 33Y is in a state of being untransferred. In the protective material layer 35, the protective material 36 is peeled from the protective material layer 35 by the transfer in a range from the transfer start position Ls to the transfer end position Le; however, the protective material 36 remains in the protective material layer 35 in the other range.

The surface property reforming unit 43 is pressed against the recording paper 50 through the protective material layer 37 having been transferred, and transmits heat energy of the thermal head 11 to the protection layer 52. The surface property reforming unit 43 is pressed over the range from the reforming start position Rs to the reforming end position Re. In the surface property reforming process, since heating and pressing is performed through the protective material layer 37 that is in the uniform state of having been transferred, positioning between the transfer start position Ls of the protective material layer 35 and the reforming start position Rs of the surface property reforming unit 43 is performed.

However, there is a case in which the reforming start position Rs of the surface property reforming unit 43 shifts from the transfer start position Ls of the protective material layer 35 due to the above described positioning error ΔE of the ink ribbon 30. In FIG. 7, the reforming start position Rs is positioned in the upstream side from the transfer start position Ls. Accordingly, in the upstream side of the traveling direction of the ink ribbon 30, heating and pressing is performed through a region other than the protective material layer 37 having been transferred, so that the protective material 36 remaining in the protective material layer 35 is adhered to the reforming ribbon 40.

3. First Embodiment

Therefore, in an image forming method according to an embodiment of the present disclosure, to prevent the heating and pressing from being performed through the region other than the protective material layer 37 having been transferred, a region AL (protection layer formation region AL) to form the protection layer 52 on the recording paper 50 is expanded.

First, the image forming method according to a first embodiment of the present disclosure will be described with reference to FIGS. 8 to 10. In the first embodiment, the protection layer formation region AL is expanded in a conveying direction of the recording paper 50.

Figure 8:
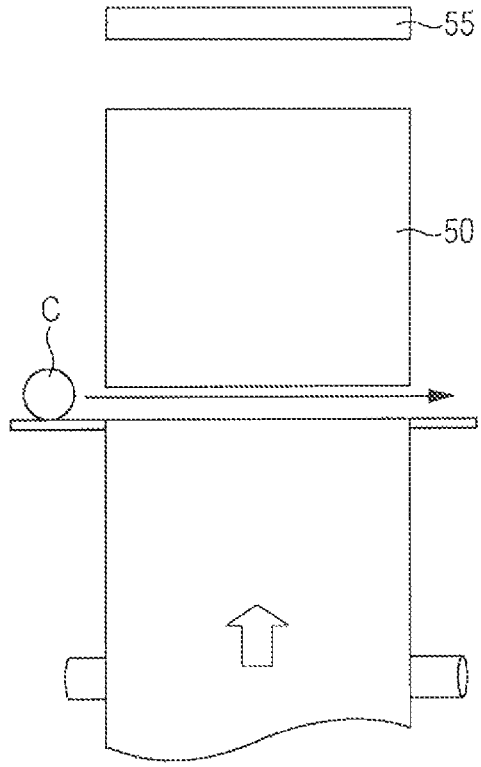
FIG. 8 is a diagram showing a cutting method of a recording paper according to an embodiment.
Figure 8:
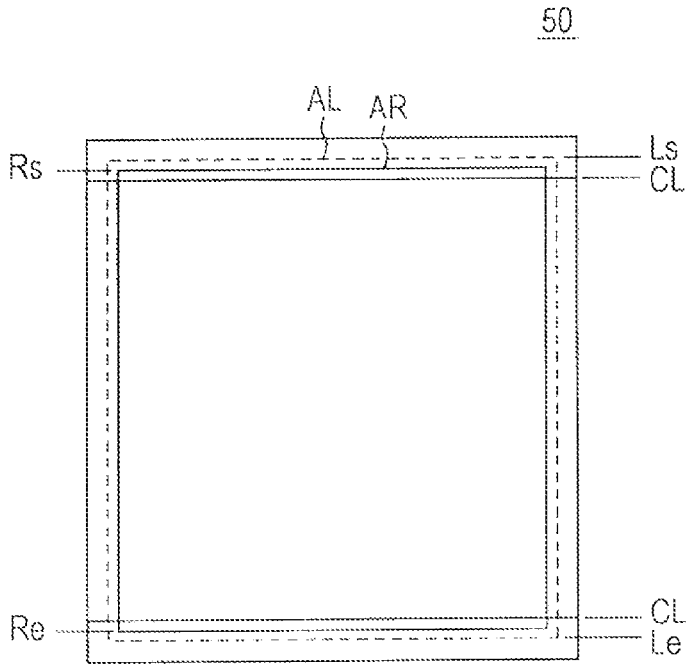

In FIG. 8, a cutting method of the recording paper 50 according to the first embodiment is shown. As shown in FIG. 8, in the upstream side of a paper discharging tray (not shown) of the image forming apparatus 1, a cutter C for cutting the recording paper 50 along a cutting line CL perpendicular to the conveying direction of the recording paper 50 is provided. The cutter C cuts the recording paper 50 by being moved in a direction perpendicular to the conveying direction of the recording paper 50.

When the surface property reforming process is completed, first, a front end of the recording paper 50 as a margin part 55 is cut by the cutter C. Here, the margin part 55 corresponds to a region in which a final printed article is not configured, from among regions on the recording paper 50. Since the platen roller 12 is heated by a part (part projected from the recording paper 50) of the thermal head 11, the margin part 55 is provided to prevent the platen roller 12 from being deteriorated by thermal deformation, etc.

Next, the recording paper 50 is conveyed in a paper discharging direction over a predetermined length corresponding to a size of the final printed article, and a rear end of the recording paper 50 is cut by the cutter C to thereby be discharged as the final printed article. Further, the margin part 55 cut by the cutter C is received in a paper chip storage unit (not shown) attached to the image forming apparatus 1 to be discarded.

Figure 9:
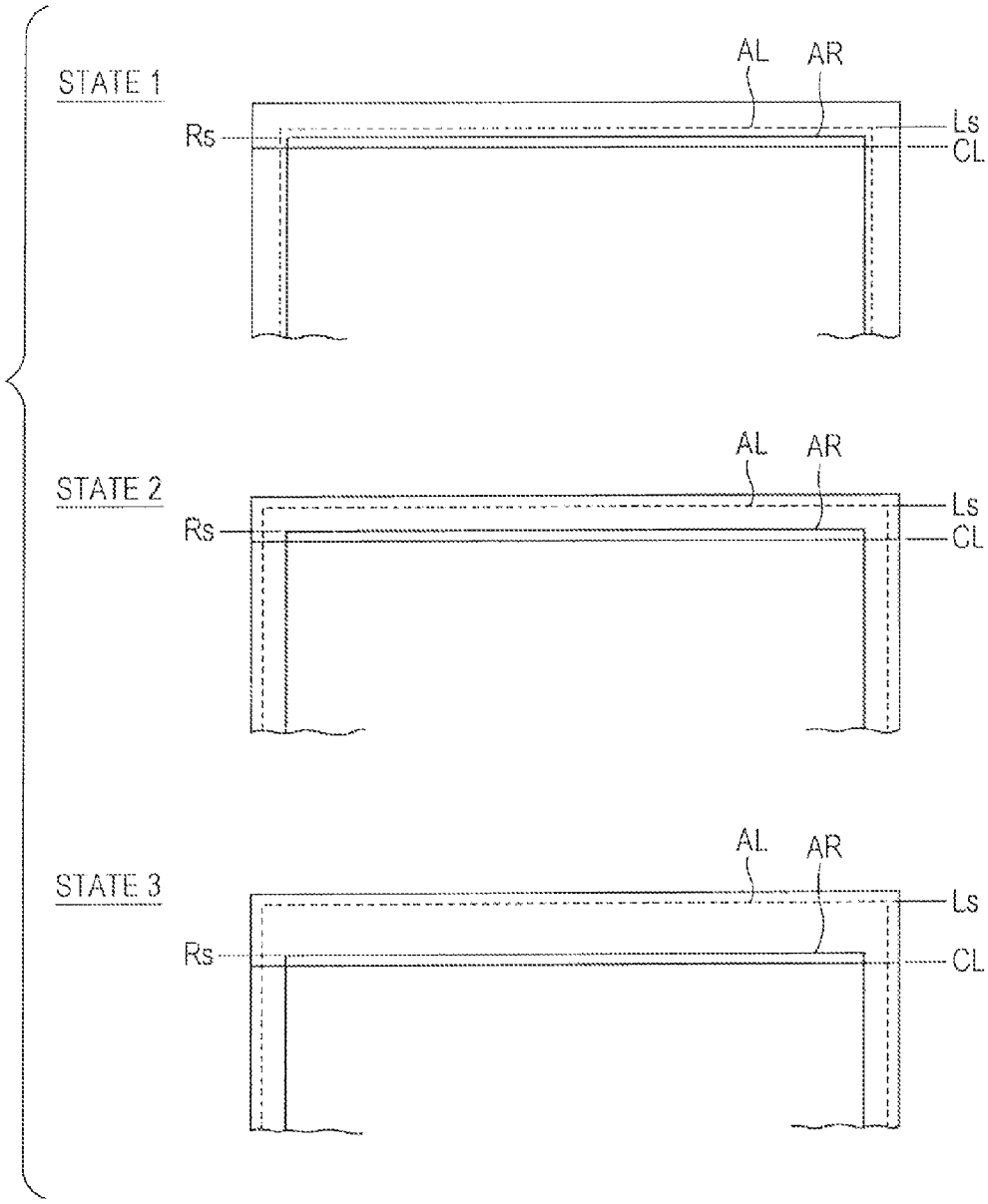
FIG. 9 is a diagram showing an example in which a protection layer formation region is expanded according to an embodiment.

In FIG. 9, an example in which the protection layer formation region AL is expanded according to the first embodiment of the present disclosure is shown. In a state 1 of FIG. 9, a case in which the protection layer formation region AL is not expanded is shown. In the state 1, in the margin part 55 that does not configure the final printed article, the protection layer 52 is not entirely formed, or only a minimum protection layer 52 is formed. In addition, in the surface property reforming process, the region corresponding to a printing region on the final printed article, from among the protection layer formation region AL, is reformed. Further, the state 1 corresponds to FIG. 7.

The states 2 and 3 of FIG. 9 show the protection layer formation region AL according to the first embodiment. Further, in FIG. 9, the protection layer formation region AL in which only an upstream end of the recording paper 50 is expanded is shown; however, it is preferable that the protection layer formation region AL is expanded even in a downstream end of the recording paper 50 according to the occurrence state of the positioning error ΔE of the ink ribbon 30 in the same manner as that of the upstream end.

In the state 2, in order to form the protection layer 52 in a range as much as possible in which deterioration in the platen roller 12 does not occur, the protection layer formation region AL is expanded toward the margin part 55. Accordingly, a region of the protective material layer 37 having been transferred which is formed on the ink ribbon 30 is expanded.

Here, when forming the protection layer 52, the protection layer formation region AL is expanded by changing the transfer start/end positions Ls and Le of the protective material layer 35 on the recording paper 50. The transfer start/end positions Ls and Le are changed by controlling operations of the thermal head 11 and the ink ribbon traveling unit 16 through the controller 22. The protection layer formation region AL is expanded to be wider than a region AR (surface property reforming region AR) to reform the surface property of the protection layer 52 in the conveying direction of the medium 50 to be recorded.

Thus, in a case in which the protection layer formation region AL is expanded to a degree capable of absorbing the positioning error ΔE, it is possible to prevent the protective material 36 from being adhered to the reforming ribbon 40.

In the state 3, the margin part 55 is expanded in comparison with the state 1. In addition, in order to form the protection layer 52 as much as possible in the range in which deterioration in the platen roller 12 does not occur, the protection layer formation region AL is expanded toward the margin part 55. Accordingly, in comparison with the state 2, the region of the protective material layer 37 having been transferred which is formed on the ink ribbon 30 is further expanded.

Here, when forming the printing layer 51 and the protection layer 52, the margin part 55 is expanded by changing transfer start/end positions Ys/Ye, Ms/Me, Cs/Ce, and Ls/Le of the ink layer 33 and the protective material layer 35 on the recording paper 50. The transfer start/end positions Ys/Ye, Ms/Me, Cs/Ce, and Ls/Le are changed by controlling operations of the thermal head 11, the ink ribbon traveling unit 16, and the reforming ribbon traveling unit 19 through the controller 22. The protection layer formation region AL is expanded to be wider than the surface property reforming region AR in the conveying direction of the medium 50 to be recorded.

Due to this, even in a case in which the positioning error ΔE is not absorbed in the state 2, the protection layer formation region AL is further expanded by the expansion of the margin part 55, so that it is possible to prevent the protection material 36 from being adhered to the reforming ribbon 40.

Figure 10:
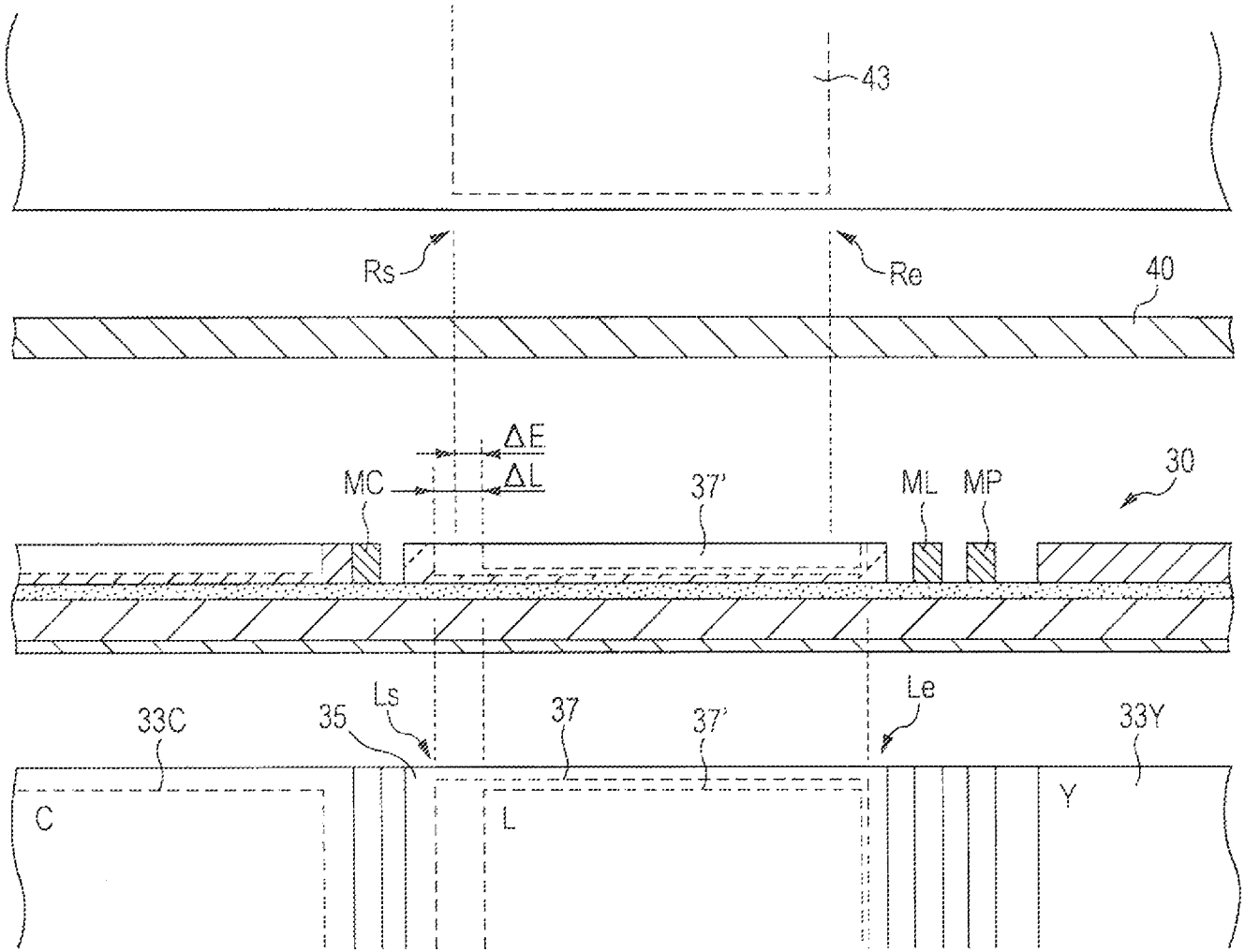
FIG. 10 is a diagram showing a state in which a protection layer formation region is expanded.

In FIG. 10, an adhesion state of the protective material 36 in the case in which the protection layer formation region AL is expanded is shown. FIG. 10 corresponds to the state 2 of FIGS. 7 and 9. In FIG. 10, for the purpose of comparison with the case shown in FIG. 7, a region of the protective material layer 37' having been transferred before expanding the protection layer formation region AL is shown.

In FIG. 10, in the same manner as that of FIG. 7, the positioning error ΔE of the ink ribbon 30 occurs. However, the transfer start position Ls of the protective material layer 35 is moved to the upstream side by a quantity ΔL of expansion by means of the expansion of the protection layer formation region AL, so that the reforming start position Rs is positioned within the protection layer formation region AL. That is, the positioning error ΔE is absorbed within the region in which the protection layer formation region AL is expanded. Thus, heating and pressing are prevented from being performed through regions other than the protective material layer 37 having been transferred, so that the protective material 36 remaining in the protective material layer 35 is prevented from being adhered to the reforming ribbon 40.

4. Second Embodiment

Next, the image forming method according to a second embodiment of the present disclosure will be described with reference to FIGS. 11 and 12. In the second embodiment, the protection layer formation region AL is expanded in the conveying direction of the recording paper 50 and in a direction perpendicular to the conveying direction thereof.

Figure 11:
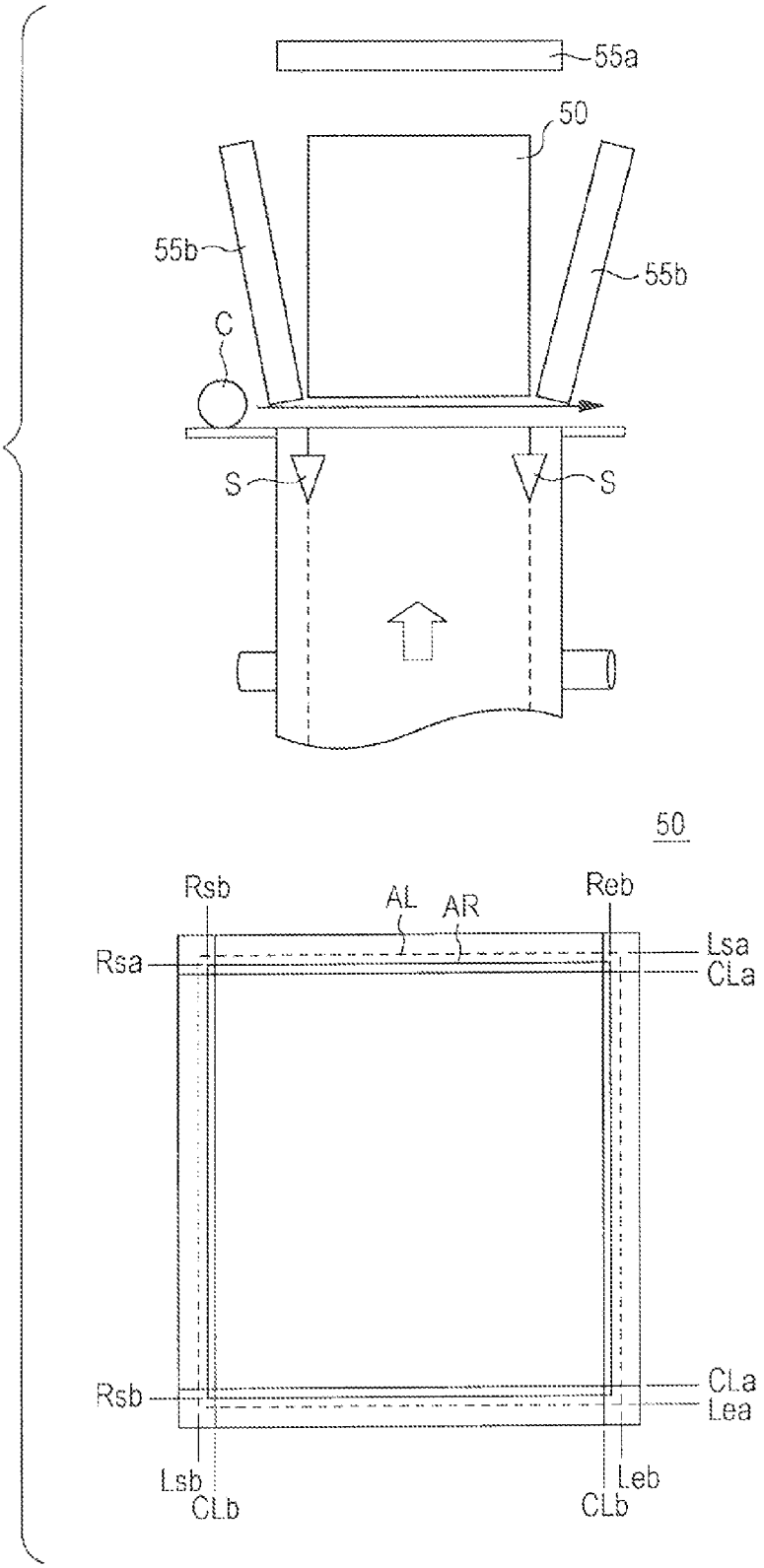
FIG. 11 is a diagram showing a cutting method of a recording paper according to another embodiment.

In FIG. 11, a cutting method of the recording paper 50 according to the second embodiment is shown. As shown in FIG. 11, in the upstream side of the paper discharging tray (not shown) of the image forming apparatus 1, a cutter C for cutting the recording paper 50 along a cutting line CLa perpendicular to the conveying direction of the recording paper 50 is provided. In addition, in the upstream side of the cutter C, two slitters S for cutting the recording paper 50 along a cutting line CLb parallel to the conveying direction while the recording paper 50 is conveyed are provided.

When the surface property reforming process is completed, first, the front end of the recording paper 50 as a margin part 55*a* is cut by the cutter C to be discarded. Next, the recording paper 50 is conveyed in the paper discharging direction over a predetermined length corresponding to the size of the final printed article. Here, while the recording paper 50 is conveyed, right and left end portions of the recording paper 50 as a margin part 55*b* are cut by the two slitters S. Next, the rear end of the recording paper 50 is cut by the cutter C, and discharged as the final printed article. Further, the margin parts 55*a* and 55*b* cut by the cutter C or the slitters S are received in the paper chip storage unit (not shown) attached to the image forming apparatus 1 to be discarded.

Figure 12:
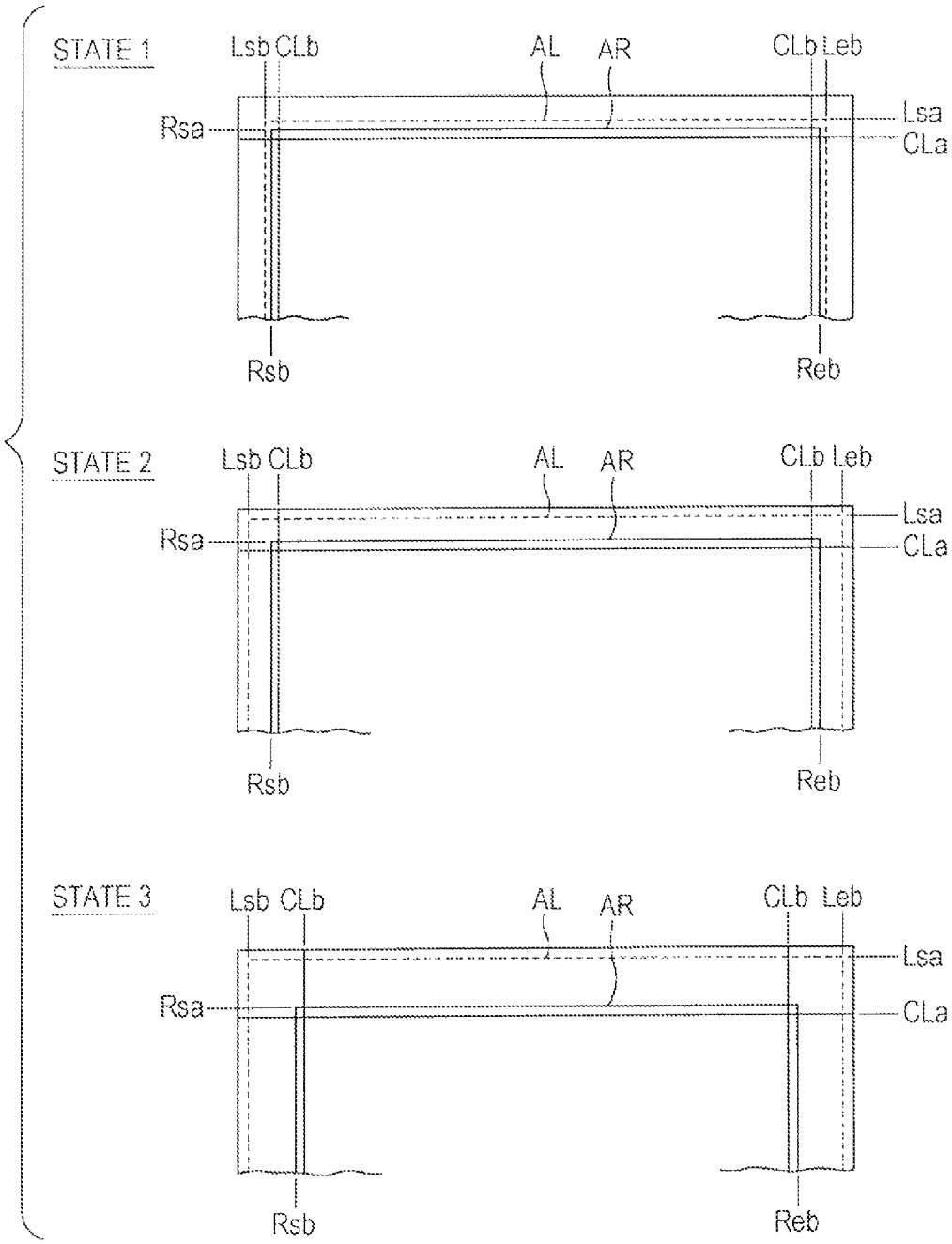
FIG. 12 is a diagram showing an example in which a protection layer formation region is expanded according to a second embodiment.

In FIG. 12, an example in which the protection layer formation region AL is expanded according to the second embodiment is shown. In FIG. 12, the protection layer formation region AL corresponds to regions (not shown) Lsa to Lea in the conveying direction and regions Lsb to Leb in a direction perpendicular to the conveying direction. Similarly, the surface property reforming region AR corresponds to regions (not shown) Rsa to Rea in the conveying direction and regions Rsb to Reb in the direction perpendicular to the conveying direction.

In the state 1 of FIG. 12, a case in which the protection layer formation region AL is not expanded is shown. In the state 1, in the margin parts 55*a* and 55*b* in which the final printed article is not configured, the protection layer 52 is not entirely formed, or only a minimum protection layer 52 is formed. In addition, in the surface property reforming process, the region corresponding to a printing region on the final printed article, from among the protection layer formation region AL, is reformed.

The states 2 and 3 of FIG. 12 show the protection layer formation region AL according to the second embodiment. Further, also in FIG. 12, the protection layer formation region AL in which the upstream end of the recording paper 50 is expanded is shown; however, it is preferable that the protection layer formation region AL is expanded even in a downstream end of the recording paper 50 according to the occurrence state of the positioning error ΔE of the ink ribbon 30 in the same manner as that in the upstream end. In addition, the protection layer formation region AL may be expanded only in the direction perpendicular to the conveying direction of the recording paper 50.

In the state 2, even in the direction perpendicular to the conveying direction of the recording paper 50, the protection layer formation region AL is expanded. That is, the protection layer formation region AL is expanded to be wider than the surface property reforming region AR even in the direction perpendicular to the conveying direction of the medium 50 to be recorded.

Here, when forming the protection layer 52, the protection layer formation region AL is expanded even in the direction perpendicular to the conveying direction of the medium 50 by changing a transfer width of the protective material layer 35 on the recording paper 50. The protection layer formation region AL is expanded to be wider than the surface property reforming region AR even in the direction perpendicular to the conveying direction of the recording paper 50.

Thus, in a case in which the protection layer formation region AL is expanded to a degree capable of absorbing the positioning error ΔE even when the positioning error ΔE of the ink ribbon 30 occurs in the direction perpendicular to the conveying direction of the recording paper 50, it is possible to prevent the protective material 36 from being adhered to the reforming ribbon 40.

In the state 3, even in the direction perpendicular to the conveying direction of the recording paper 50, the margin part 55*b* is expanded in comparison with the state 1. Accordingly, even in the direction perpendicular to the conveying direction of the recording paper 50, the region of the protective material layer 37 having been transferred which is formed on the ink ribbon 30 is further expanded.

Here, when forming the printing layer 51 and the protection layer 52, the margin part 55*b* is expanded even in the direction perpendicular to the conveying direction of the recording paper 50 by changing a transfer width of the ink layer 33 and the protective material layer 35 on the recording paper 50. The protection layer formation region AL is expanded to be wider than the surface property reforming region AR even in the direction perpendicular to the conveying direction of the medium to be recorded 50.

Thus, even in a case in which the positioning error ΔE of the ink ribbon 30 is not absorbed in the state 2, it is possible to prevent the protective material 36 from being adhered to the reforming ribbon 40 by further increasing the protection layer formation region AL by the expansion of the margin part 55*b*.

Therefore, as described with reference to FIG. 12, even in the case in which the positioning error ΔE occurs in the direction perpendicular to the conveying direction of the recording paper 50 for a certain reason, it is possible to prevent heating and pressing from being performed through the region other than the protective material layer 37 having been transferred. Accordingly, the protective material 36 remaining in the protective material layer 35 is prevented from being adhered to the reforming ribbon 40.

5. Summary

As described above, according to the image forming method of the embodiments of the present disclosure, the region AL to form the protection layer 52 is expanded to be wider than the region AR to reform the surface property of the protection layer 52. Thus, in a case in which the positioning error ΔE is absorbed within an expanded range of the protection layer formation region AL even when the positioning error ΔE of the ink ribbon 30 occurs, it is possible to prevent the protective material 36 from being adhered to the reforming ribbon 40. Accordingly, even when repeatedly using the reforming ribbon 40, it is possible to prevent a reforming failure of the surface property or a peeling failure of the reforming ribbon 40 from occurring.

For example, as above, a case in which the present disclosure is applied to the sublimation type printer has been described; however, the present disclosure may be equally applied to even a thermal transfer printer such as a fusion type printer, a thermal type printer, and the like.

The present disclosure contains subject matter related to that disclosed in Japanese Priority Patent Application JP 2010-196649 filed in the Japan Patent Office on Sep. 2, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus, comprising:

a conveyance unit that conveys a medium to be recorded in a predetermined direction;

a thermal transfer sheet that includes an ink layer which is thermally transferred onto the medium to be recorded to form a printing layer, and a protective material layer which is thermally transferred onto the medium to be recorded to form a protection layer;

a transfer sheet traveling unit that causes the thermal transfer sheet to travel;

a reforming sheet that includes a printing opening for bringing the ink layer and the protective material layer into contact with a surface of the medium to be recorded, and a surface property reforming unit for reforming a surface property of the protection layer;

a reforming sheet traveling unit that causes the reforming sheet to travel; and a thermal head that presses the surface property reforming unit on the medium to be recorded through the protective material layer having been thermally transferred to thereby heat the pressed surface property reforming unit, while thermally transferring the ink layer and the protective material layer on the medium to be recorded, wherein a region to form the protection layer is expanded to be wider than a region to reform the surface property of the protection layer.

2. The image forming apparatus according to claim 1, wherein the region to form the protection layer is expanded to be wider than the region to reform the surface property of the protection layer in a conveying direction of the medium to be recorded.

3. The image forming apparatus according to claim 1, wherein the region to form the protection layer is expanded to be wider than the region to reform the surface property of the protection layer in a direction perpendicular to a conveying direction of the medium to be recorded.

4. The image forming apparatus according to claim 2, wherein the region to form the protection layer extends to a margin part in which the medium to be recorded is expanded.

5. An image forming method, comprising:

sandwiching a reforming sheet including a printing opening and a surface property reforming unit in between a medium to be recorded and a thermal transfer sheet including an ink layer and a protective material layer;

causing the medium to be recorded, the thermal transfer sheet, and the reforming sheet to travel in a predetermined direction;

thermally transferring the ink layer onto the medium to be recorded to form a printing layer by enabling a printing position of the medium to be recorded and the ink layer to be aligned with the printing opening;

thermally transferring the protective material layer onto the medium to be recorded to form a protection layer by enabling the printing position of the medium to be recorded and the protective material layer to be aligned with the printing opening; and pressing the surface property reforming unit on the medium to be recorded through the protective material layer having been thermally transferred by enabling the printing position of the medium to be recorded and the protective material layer to be aligned with the surface property reforming unit, and heating the pressed surface property reforming unit to thereby reform surface property of the protection layer, wherein a region to form the protection layer is expanded to be wider than a region to reform the surface property of the protection layer.

6. A non-transitory computer readable medium having stored there on a program for image forming, wherein the program when executed by a computer causes the computer to perform the steps of:

sandwiching a reforming sheet including a printing opening and a surface property reforming unit in between a medium to be recorded and a thermal transfer sheet including an ink layer and a protective material layer;

causing the medium to be recorded, the thermal transfer sheet, and the reforming sheet to travel in a predetermined direction;

thermally transferring the ink layer onto the medium to be recorded to form a printing layer by enabling a printing position of the medium to be recorded and the ink layer to be aligned with the printing opening;

thermally transferring the protective material layer onto the medium to be recorded to form a protection layer by enabling the printing position of the medium to be recorded and the protective material layer to be aligned with the printing opening; and pressing the surface property reforming unit on the medium to be recorded through the protective material layer having been thermally transferred by enabling the printing position of the medium to be recorded and the protective material layer to be aligned with the surface property reforming unit, and heating the pressed surface property reforming unit to thereby reform surface property of the protection layer, wherein a region to form the protection layer is expanded to be wider than a region to reform the surface property of the protection layer.

* * * * *